US010060691B2

(12) United States Patent
Kunz

(10) Patent No.: US 10,060,691 B2
(45) Date of Patent: Aug. 28, 2018

(54) FIREARM MAGAZINE FOLLOWER WITH ENHANCED STABILITY AND DEBRIS CLEARING FEATURES

(71) Applicant: Joshua M. Kunz, Exton, PA (US)

(72) Inventor: Joshua M. Kunz, Exton, PA (US)

( * ) Notice: Subject to any disclaimer, the term of this patent is extended or adjusted under 35 U.S.C. 154(b) by 0 days.

(21) Appl. No.: 15/687,844

(22) Filed: Aug. 28, 2017

(65) Prior Publication Data

US 2018/0073826 A1 Mar. 15, 2018

Related U.S. Application Data

(63) Continuation of application No. 62/380,379, filed on Aug. 27, 2016.

(51) Int. Cl.
*F41A 9/70* (2006.01)

(52) U.S. Cl.
CPC ..... *F41A 9/70* (2013.01)

(58) Field of Classification Search
CPC ..... F41A 9/70; F41A 9/69; F41A 9/71; F41A 9/65
USPC ..... 42/50
See application file for complete search history.

(56) References Cited

U.S. PATENT DOCUMENTS

| | | | | |
|---|---|---|---|---|
| 2,366,684 | A * | 1/1945 | Garand | F41A 9/70 42/50 |
| 4,888,899 | A * | 12/1989 | Chesnut | F41A 9/70 42/50 |
| 5,450,683 | A * | 9/1995 | Miller, IV | F41A 9/65 221/278 |
| 7,621,063 | B2 | 11/2009 | Fitzpatrick et al. | |
| 8,166,692 | B2 | 5/2012 | Fitzpatrick et al. | |
| 9,383,151 | B2 * | 7/2016 | Ballard | F41A 9/65 |
| 9,752,839 | B2 * | 9/2017 | Ballard | F41A 9/70 |
| 2012/0246988 | A1 * | 10/2012 | Ladner | F41A 9/71 42/49.02 |
| 2013/0167420 | A1 * | 7/2013 | Zheng | F41A 9/70 42/50 |
| 2014/0075810 | A1 * | 3/2014 | Mikroulis | F41A 17/36 42/50 |
| 2014/0283427 | A1 * | 9/2014 | Castro | F41A 9/67 42/49.01 |
| 2015/0267981 | A1 * | 9/2015 | Faughn | F41A 9/62 42/1.02 |
| 2016/0102931 | A1 * | 4/2016 | Roberts | F41A 9/75 89/33.02 |
| 2016/0223277 | A1 * | 8/2016 | Bennett | F41A 9/70 |

* cited by examiner

*Primary Examiner* — John Cooper
(74) *Attorney, Agent, or Firm* — Carter, DeLuca, Farrell & Schmidt, LLP

(57) ABSTRACT

A follower for use in a firearm magazine includes an elongate body defining a first plane extending between a first end portion and a second, opposite end portion. The first and second end portions define grooves therein that are disposed on respective planes oriented parallel to the elongate body.

13 Claims, 6 Drawing Sheets

FIREARM MAGAZINE FOLLOWER WITH ENHANCED STABILITY AND DEBRIS CLEARING FEATURES

CROSS-REFERENCE TO RELATED APPLICATION

This application claims priority to, and the benefit of, U.S. Provisional Patent Application Ser. No. 62/380,379, filed on Aug. 27, 2016, the entire content of which is hereby incorporated by reference herein.

TECHNICAL FIELD

The present disclosure relates generally to devices and methods for dispensing ammunition, and in particular, to magazine followers for use in firearm magazines.

BACKGROUND

The advent of magazine-fed firearms follows centuries of advancements in firearm technology. The earliest firearms required a user to load loose powder and a lead ball into the barrel of the firearm before each shot could be taken. The practical limitations of this design were readily apparent, namely, the inability to fire rounds in quick succession, leading to various innovations in firearm design. Initially, gunsmiths focused on developing firearms having multiple barrels, such as double-barreled shotguns, pepper-box guns, etc. or multiple chambers in which round may be inserted, such as the revolver. However, the addition of multiple barrels or multiple chambers, such as those in the double-barreled shotgun and the revolver, respectively, led to increased weight and complexity.

In an effort to increase the speed at which a user may fire rounds while keeping the weight of the firearm to a minimum, innovation at this time focused on superposed loads, which enabled a user to load multiple projectiles in a single barrel. Like the multi-barrel and multi-chamber designs that preceded it, firearms incorporating superposed loads within their designs suffered from overly-complex mechanisms and an inability to be easily mass produced.

Integrated cartridge type ammunition consisting of a case holding the propellant and the projectile, a rim, and a primer to ignite the propellant was developed to further increase the speed in which a user may fire a round. Cartridges of this type eliminated the need for a user to pack a barrel with propellant, wadding, and the projectile each time the user wanted to fire the weapon. An early form of the cartridge type ammunition is the paper cartridge, which was popular for use with the Sharps breech-loading rifle, amongst others. Further innovation focused on increasing the durability of the cartridge and the ability of the case of the cartridge to seal the firing chamber such that more powerful cartridges may be utilized. Solid-drawn metallic cased cartridges are one of the most popular types of cartridges used in modern firearms.

Although cartridge type ammunition significantly decreased the amount of time required to re-load a firearm, there was still room to improve. The next evolution in firearm design was the tubular magazine, in which multiple cartridges could be loaded within a tubular magazine that is permanently attached to the firearm. Once the final bullet contained within the tubular magazine has been fired, the user may reload the magazine a single cartridge at a time. While considered an important step forward in firearm design, tubular magazines continued to have the shortcoming of being permanently attached to the firearm, resulting of the time consuming process of loading individual cartridges into the magazine in order to begin firing again.

The repeater style firearms that were developed during this period, such as the lever action and the bolt action rifle, set the framework for developing firearms that could fire multiple rounds in quick succession. Improving upon these designs, the detachable magazine was developed which enabled users to quickly replenish the number of rounds available to fire by simply replacing an empty magazine with a fully loaded one. These removable magazines included a simple construction having a follower and a spring. As each round is inserted within the magazine, the follower is pushed down against the bias of the spring. Therefore, as each round is fired, the spring biases the follower towards the receiver of the firearm to load another round.

As can be appreciated, however, this design enables debris and other contaminants to gather in the magazine housing or coat the inner walls of the magazine housing in which the follower slides up and down. Because each magazine is reusable, over time, the debris can inhibit movement of the follower within the magazine housing, and in some cases, cause the follower to jam or malfunction.

SUMMARY

The present disclosure relates to a follower for use in a firearm magazine including an elongate body defining a first plane extending between a first end portion and a second, opposite end portion. The first and second end portions define grooves therein that are disposed on respective planes oriented parallel to the elongate body.

In aspects, the grooves may define a dovetail configuration.

In other aspects, the side surfaces of each groove may define an angle relative to each respective first and second end portion. In certain aspects, the angle may be less than 90 degrees but greater than 80 degrees. In aspects, the angle may be at least 80 degrees.

In certain aspects, the elongate body may define an upper surface that extends between the first and second end portions. The top surface defines a boss extending therefrom and having a portion thereof being flush with the second end portion of the elongate body.

In aspects, the boss may extend towards the first end portion for at least one third of the length of the elongate body.

In other aspects, the elongate body may define opposed side surfaces extending between the first and second end portions. Each of the first and second end portions defines a respective wing extending therefrom.

In certain aspects, each wing may define an upper surface having a bevel extending therefrom and towards and upper surface of the boss.

In other aspects, the bevel may be offset towards each respective opposed side surface of the elongate body such that a portion of the upper surface of the each respective wing is exposed.

In aspects, the exposed portion of the upper surface of each respective wing may be angled towards each respective side surface of the opposed side surfaces. In certain aspects, the angle between the exposed portion of the upper surface and a respective side surface of the opposed side surfaces may be at least 80 degrees.

According to another aspect of the present disclosure, a follower for use with a firearm magazine is provided and includes an elongate body. The elongate body includes an upper surface extending between opposed side surfaces, a wing disposed on each respective side surface of the opposed side surfaces, and a bevel extending from the upper surface of each wing and towards the upper surface of the elongate body. An upper surface of each wing is offset from the upper surface and each bevel is offset towards each respective side surface of the opposed side surfaces of the elongate body such that a portion of the upper surface of each respective wing is exposed.

In aspects, the exposed portion of each respective wing may be angled towards each respective side surface of the opposed side surfaces of the elongate body. In certain aspects, the angle between the exposed portion of the upper surface and a respective side surface of the opposed side surfaces may be greater than zero degrees but less than 80 degrees. In other aspects, the angle between the exposed portion of the upper surface and a respective side surface of the opposed side surfaces may be at least 80 degrees.

In certain aspects, each wing may define grooves therein that are parallel to the upper surface of the wing.

In other aspects, the grooves may define a dovetail configuration.

In certain aspects, side surfaces of each groove may define an angle relative to each side surface of the opposed side surfaces of the elongate body that is less than 90 degrees but greater than 80 degrees.

In aspects, side surfaces of each groove may define an angle of at least 80 degrees relative to each respective side surface of the opposed side surfaces of the elongate body.

BRIEF DESCRIPTION OF THE DRAWINGS

The accompanying drawings, which are incorporated in and constitute a part of this specification, illustrate embodiments of the disclosure and, together with a general description of the disclosure given above, and the detailed description of the embodiments given below, serve to explain the principles of the disclosure, wherein.

DETAILED DESCRIPTION

Figure 1:
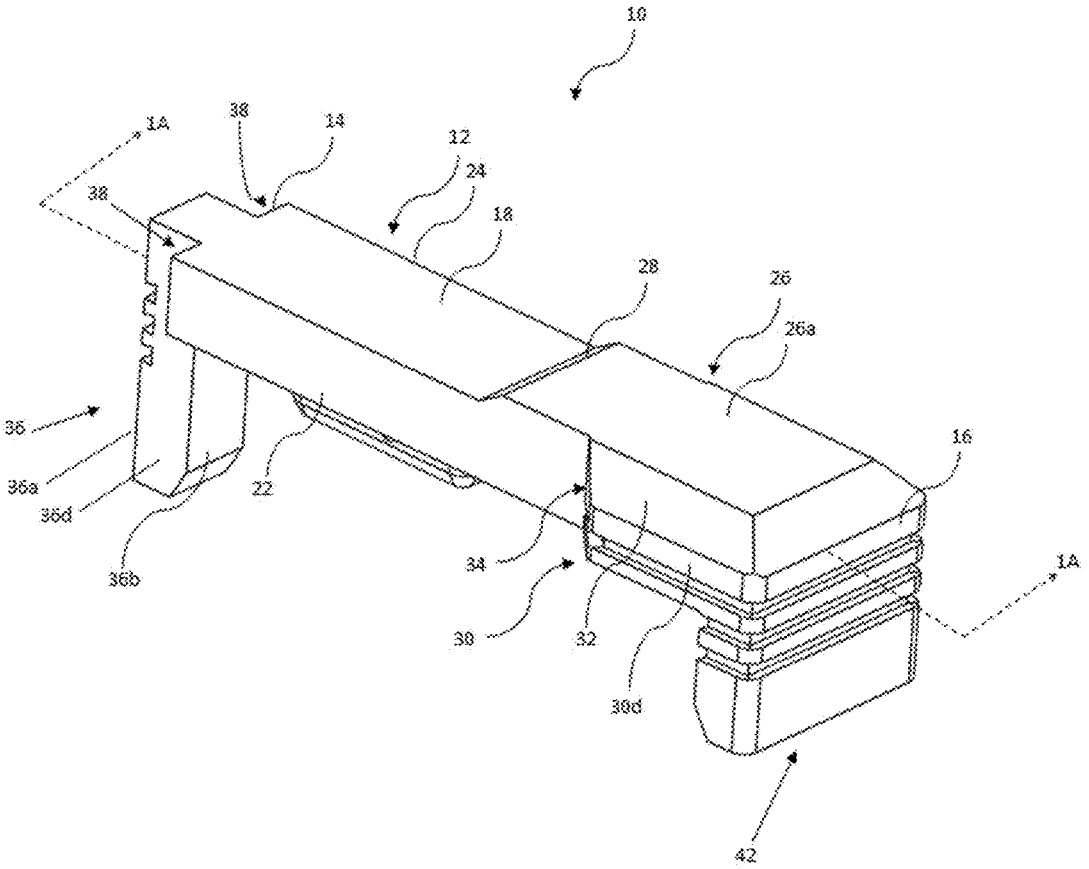
FIG. 1 is a rear perspective view of a follower for use in a firearm magazine.

The present disclosure is directed to firearm magazine followers capable of removing debris or other contaminants from the sidewalls of the magazine to inhibit jamming of the follower. As described herein, the follower defines grooves on respective end portions capable of removing the debris or other contaminants as the follower translates within the magazine housing. To promote removal of these contaminants, the grooves may include a planar configuration, a dovetail configuration, or an angled configuration such that embedded debris may be more easily removed from magazine sidewalls. As the follower translates within the magazine housing, the grooves scrape or otherwise clean the magazine sidewalls and trap the debris therewithin. In embodiments, the follower defines wings extending from opposed sidewalls thereof having a bevel that extends from an upper surface thereof to an upper surface of the follower. The bevel is offset such that a portion of an upper surface of each wing is exposed. This exposed portion of each wing is configured to serve as another scraper in addition to the grooves. In this manner, the exposed portion of each wing may be angled relative to side surfaces of the follower such that the angle is less than 90 degrees but greater than 80 degrees, or in embodiments, at least 80 degrees.

Embodiments of the present disclosure are now described in detail with reference to the drawings in which like reference numerals designate identical or corresponding elements in each of the several views. In the drawings and in the description that follows, terms such as front, rear, upper, lower, top, bottom, and similar directional terms are used simply for convenience of description and are not intended to limit the disclosure. In the following description, well-known functions or constructions are not described in detail to avoid obscuring the present disclosure in unnecessary detail.

Figure 3:
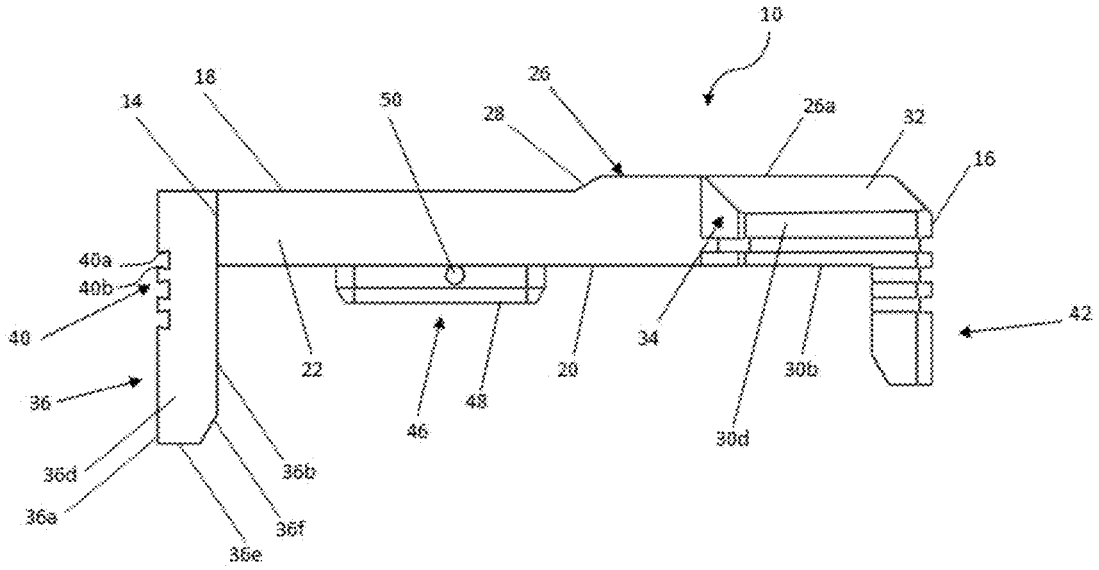
FIG. 3 is a longitudinal view of the follower of FIG. 1.
Figure 4:
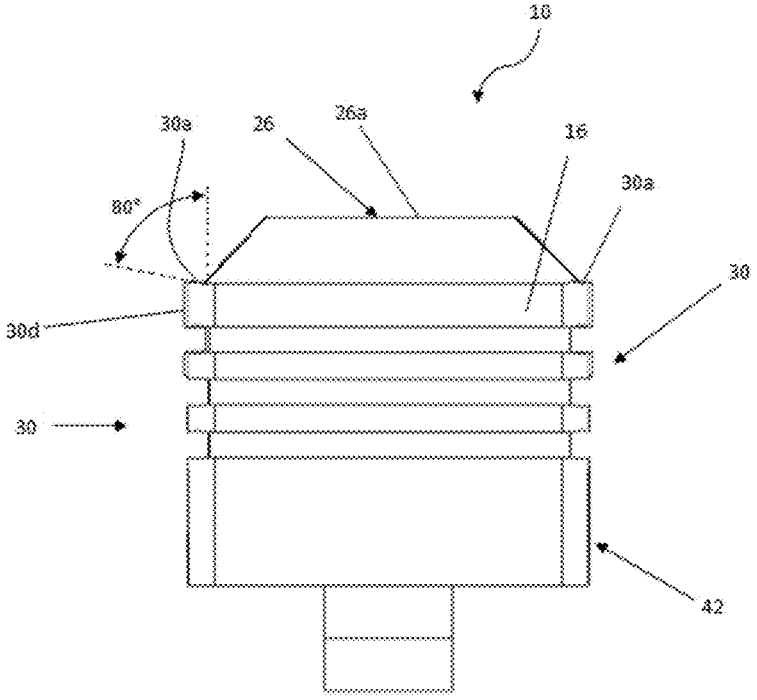
FIG. 4 is a rear view of the follower of FIG. 1.

Referring now to the drawings, a firearm magazine follower is illustrated and generally identified by reference numeral 10. As illustrated in FIG. 1, the follower 10 defines an elongate body 12 defining first end surface 14 and a second end surface 16 opposite thereto. The elongate body 12 extends between the first and second end surfaces 14, 16 to define top and bottom surfaces 18 and 20, respectively, as well as opposed side surfaces 22 and 24 (FIGS. 3 and 4). Although generally illustrated as defining a planar configuration, it is contemplated that the first and second end surfaces 14, 16, the top and bottom surfaces 18, 20, and opposed side surfaces 22, 24 may define a convex configuration, a concave configuration, etc. or combinations thereof.

Figure 2:
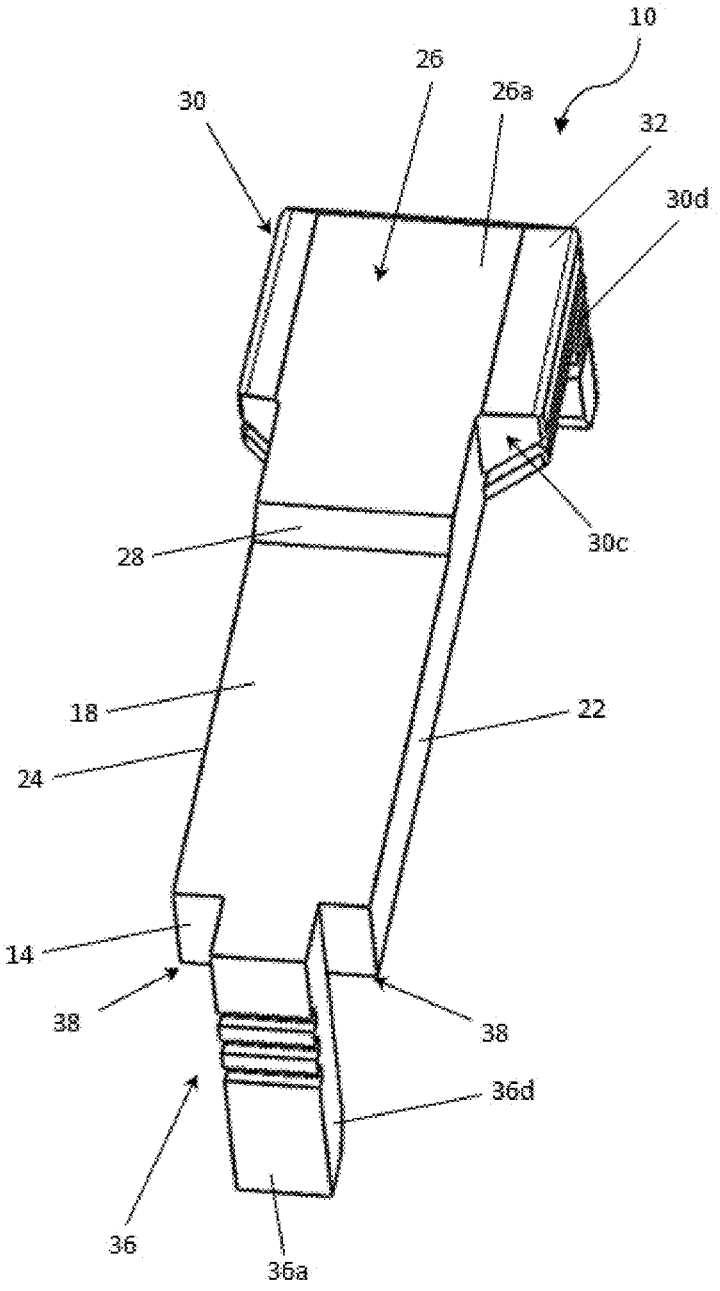
FIG. 2 is a front perspective view of the follower of FIG. 1.
Figure 7:
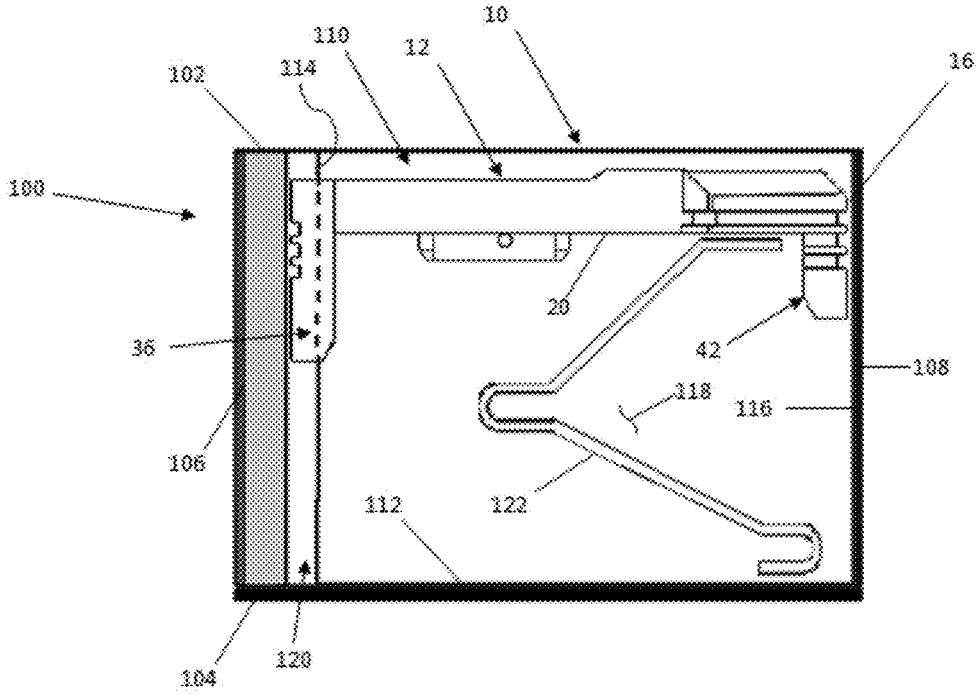
FIG. 7 is a partial longitudinal, cross-sectional view of a magazine housing including the follower of FIG. 1.

As illustrated in FIGS. 2 and 3, the top surface 18 defines a boss 26 extending therefrom and having a portion thereof being flush with the second end surface 16 of the elongate body 12, although it is contemplated that the boss 26 may be disposed at any location on the top surface 18. The boss 26 extends towards the first end surface 14 of the elongate body 12 approximately ⅓ of the length thereof and serves as a support for projectiles contained within a magazine in which the follower 10 is slidably disposed (FIG. 7). As can be appreciated, the boss 26 may extend any distance towards the first end surface 14 depending upon the type of ammunition (not shown) being utilized. The intersection of the top surface 18 and the boss 26 defines a bevel 28 interconnecting the top surface 18 of the elongate body 12 and a top surface 26*a* of the boss 26 to provide a smooth transition therebetween.

Figure 5:
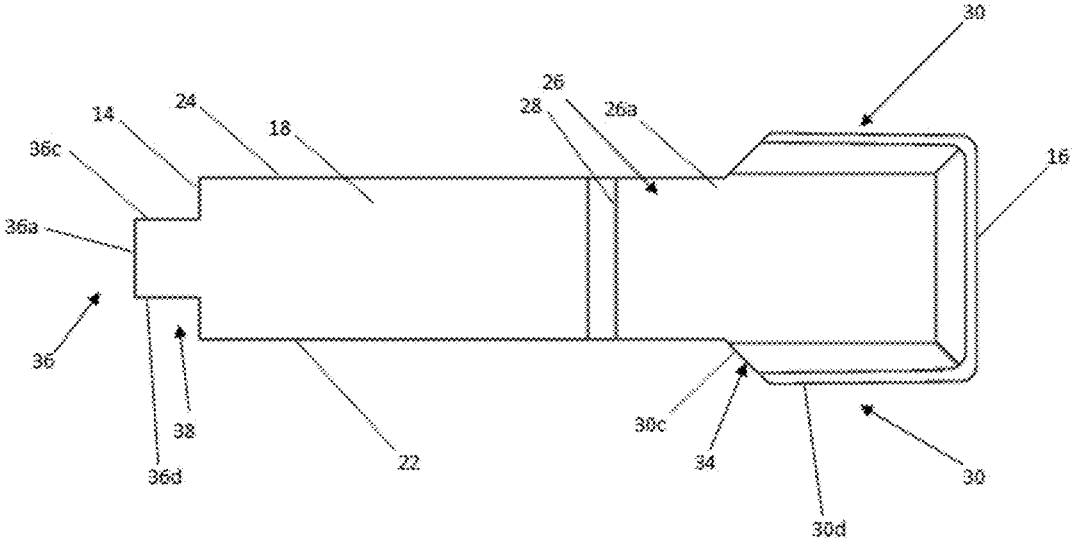
FIG. 5 is a top view of the follower of FIG. 1.

Each side surface of the opposed side surfaces 22, 24 defines a respective tab or wing 30 extending therefrom. Each wing 30 is substantially similar to one another, and therefore, only one wing 30 will be described in detail herein for purposes of brevity. As illustrated in FIG. 5, the wing 30 is disposed on the side surface 22 such that the wing 30 is flush with the second end surface 16 of the elongate body. The wing 30 defines an upper and lower surface 30*a* and 30*b*, respectively, extending between the second end surface 16 and a first surface 30*c* disposed opposite thereto, and between the side surface 22 of the elongate body 12 and a side surface 30*d* of the wing 30 disposed opposite thereto.

The side surfaces 30*d* of the wings 30 are configured to provide an additional bearing surface area against the inner surfaces of the magazine housing 100 (FIG. 7) to increase the stability of the follower 10 within the magazine housing 100. In this manner, the wings 30 inhibit the follower 10 from rotating about a vertical axis defined by the magazine housing 100.

The upper surface 30*a* of the wing is offset from the top surface 18 of the elongate body 12 in a direction towards the lower surface 30*b*. As illustrated in FIG. 4, the upper surface 30*a* is generally co-planar with the top surface 18 of the elongate body 12, however, it is contemplated that the upper surface 30*a* may define an acute or obtuse angle relative to the side surface 22 of the elongate body 12, and in embodiments, may define an angle that is at least 80 degrees to the side surface 22. The upper surface 30*a* defines a bevel 32 extending toward, and flush with, the top surface 18 of the elongate body 12. The bevel 32 is set back from the side surface 30*d* of the wing 30 such that a portion of the upper surface 30*a* is exposed. The first end surface 30*c* defines a bevel 34 extending from the intersection between the first end surface 30*c* and the side surface 30*d* of the wing 30 to the side surface 22 of the elongate body 12 in the direction of the first end surface 14.

With reference to FIG. 2, the first end surface 14 of the elongate body defines a first arm 36 thereon and extending therefrom. The first arm 36 extends from the top surface 18 of the elongate body towards and extending past the bottom surface 20. As can be appreciated, the first arm 36 may extend past the bottom surface 20 of the elongate body any suitable amount depending upon the type of magazine the follower 10 is intended to be utilized in. The first arm 36 defines opposed end surfaces 36*a* and 36*b*, respectively and opposed side surfaces 36*c* and 36*d*, respectively. As illustrated in FIGS. 2 and 5, the opposed side surfaces 36*c*, 36*d* of the first arm 36 are offset from the opposed side surfaces 22, 24 of the elongate body to define respective reliefs 38. In this manner, the first arm 36 and the first end surface 14 of the elongate body define a generally T-shaped configuration, although any suitable configuration is contemplated. A bottom surface 36*e* extends between each of the opposed end surfaces 36*a*, 36*b* and the opposed side surfaces 36*c*, 36*d*. The intersection between the side surface 36*b* and the bottom surface 36*e* defines a chamfer 36*f* thereon.

Figure 8:
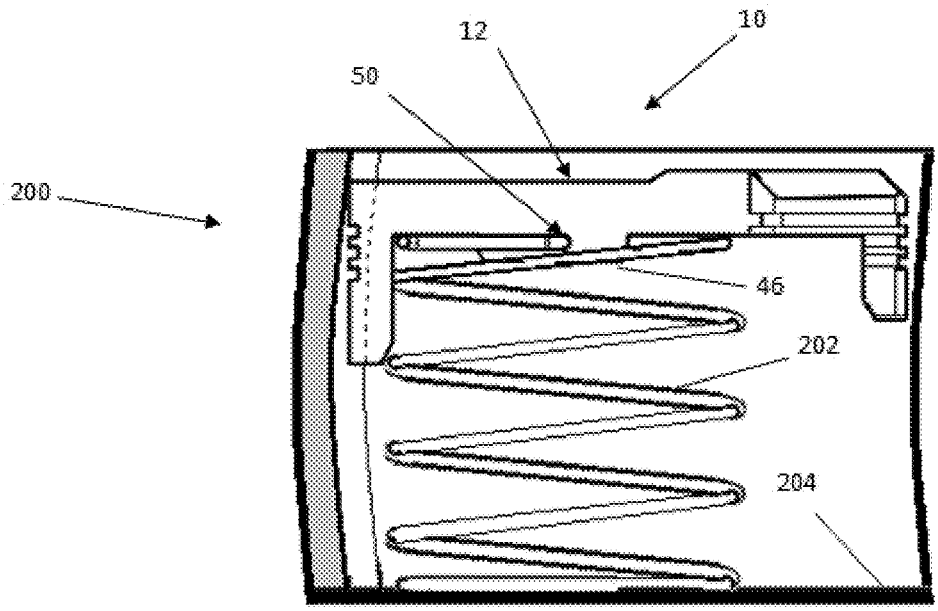
FIG. 8 is a partial longitudinal, cross-sectional view of another embodiment of a magazine housing including the follower of FIG. 1.

As can be appreciated, the T-shaped configuration and the extended length of the first leg 36 acts as a bearing surface against an inner surface of a magazine housing 100 (FIGS. 7 and 8). In this manner, the T-shaped profile of the first leg 36 is configured to be received within a corresponding channel 120 defined within an inner side surface 114 of a magazine housing 100 (FIGS. 7 and 8) to inhibit rotation of the follower 10 in a transverse direction therewithin and the extended length of the first leg 36 inhibits rotation of the follower 10 in a longitudinal direction, thereby providing increased stability and inhibiting pitching and jamming of the follower 10 within the magazine housing 100 during translation of the follower 10 therewithin.

Turning to FIGS. 2 and 3, the side surface 36*a* of the first arm 36 defines a first plurality of grooves or channels 40 therein and extending through each of the opposed side surfaces 36*c*, 36*d*. Although generally illustrated as defining a dovetail type arrangement (e.g., defining an acute angle to the side surface 36*a*), it is contemplated that each sidewall 40*a* and 40*b* of each respective channel 40 may be oriented perpendicular to the side surface 36*a*, may define a obtuse angle relative to the side surface 36*a*, or combinations thereof. In embodiments, the sidewalls 40*a*, 40*b* of the channel 40 may define an angle that is at least 80 degrees to the side surface 36*a*. In one non-limiting embodiment, the first plurality of channels 40 includes three channels, although it is contemplated that the first plurality of channels 40 may include any suitable number of channels. It is contemplated that each groove of the first plurality of channels 40 may include the same configuration, or may include any suitable combination of configurations, such as a first channel having a dovetail configuration, a second channel having a planar configuration, and a third channel having one acute surface and one obtuse surface, or combinations thereof.

As can be appreciated, a buildup of debris or contaminants within the magazine housing 100 can lead to increased friction against movement of the follower 10 therewithin which may ultimately result in an increased chance of the follower 10 jamming. To alleviate this issue, the planar, dovetail, or angled configuration of the first plurality of channels 40 is configured to act as a scraper or wiper to remove or clean debris or other contaminants from the inner surface of the magazine housing 100 during translation of the follower 10 therewithin. Further, the first plurality of grooves provides a recess in which the removed debris may be received.

Figure 1A:
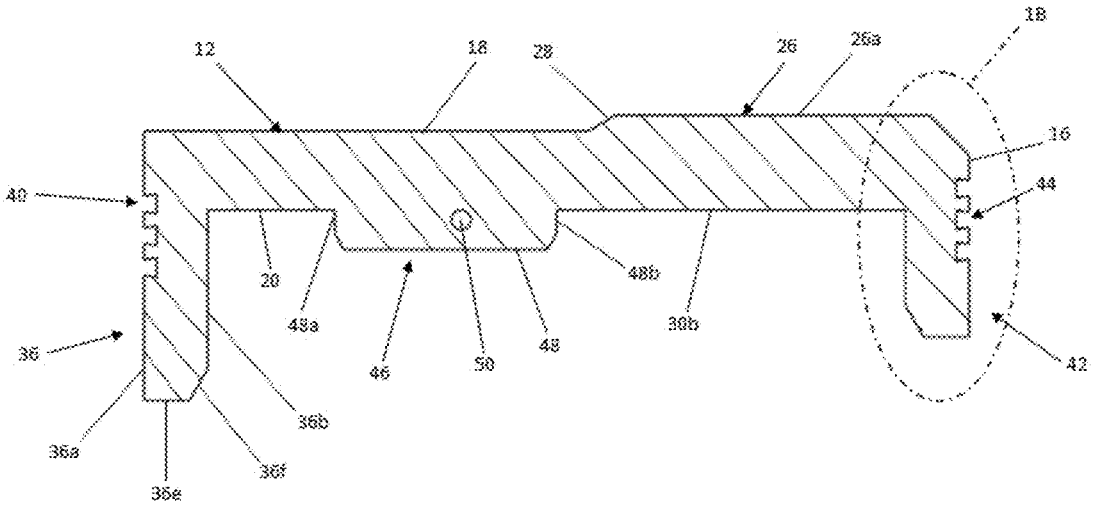
FIG. 1A is longitudinal, cross-sectional view of the follower of FIG. 1 taken along 1A-1A of FIG. 1.
Figure 1B:
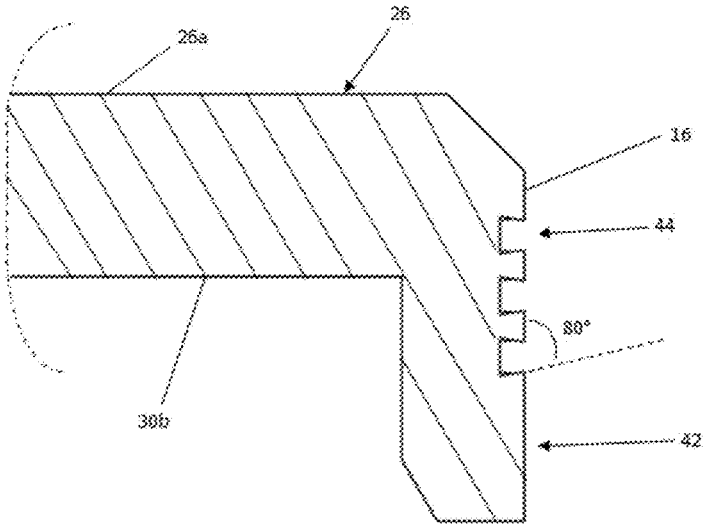
FIG. 1B is an enlarged view of the area of detail of FIG. 1A.

With reference to FIGS. 1 and 3, the bottom surface 20 of the elongate body 12 defines a second arm 42 extending therefrom. Although generally illustrated as being shorter than the first arm 36 (e.g., does not extend to or past the bottom surface 36*e* of the first arm 36), it is contemplated that the second arm 42 may define any length and may be equal in length, or longer than, the first arm 36, depending upon the type of magazine the follower 10 is intended to be utilized in. The second arm 42 is flush with the second end surface 16 of the elongate body 12 and is extends between and is flush with each side surface 30*d* of each respective wing 30. As illustrated in FIGS. 1A and 1B, the second arm 42 extends partially towards the first end surface 14 of the elongate body 12. It is contemplated that the second arm 42 may extend any suitable distance towards the first end surface 14 depending upon the needs and design requirements of the magazine in which the follower 10 is intended to be utilized.

Continuing with FIGS. 1A and 1B, the second end surface 16 of the elongate body 12 defines a second plurality of channels 44 extending between each of the side surfaces 30*d* of each respective wing 30. The second plurality of channels 44 extends through each side surface 30*d* of each respective wing 30. Although generally illustrated as including three channels, it is contemplated that the second plurality of channels 44 may include any suitable number of channels, and may include the same number of channels as the first plurality of channels 40. Additionally, it is contemplated that the second plurality of channels 44 may be aligned with the first plurality of channels 40 or may be offset relative thereto. In embodiments, individual channels of each of the first and second plurality of channels 40, 44 may be aligned or offset. The profile of the second plurality of channels 44 is substantially similar to the first plurality of channels 40, and therefore, will not be described in detail herein in the interest of brevity. However, it is contemplated that the second plurality of channels 44 may have the same or different configuration than the first plurality of channels 40. As can be appreciated, the second plurality of channels 44 provide a similar function to that of the first plurality of channels, such that the first plurality of channels removes debris from a first portion of the magazine housing 100

(FIG. 7) whereas the second plurality of channels 44 removes debris from a second portion of the magazine housing 100.

Figure 6:
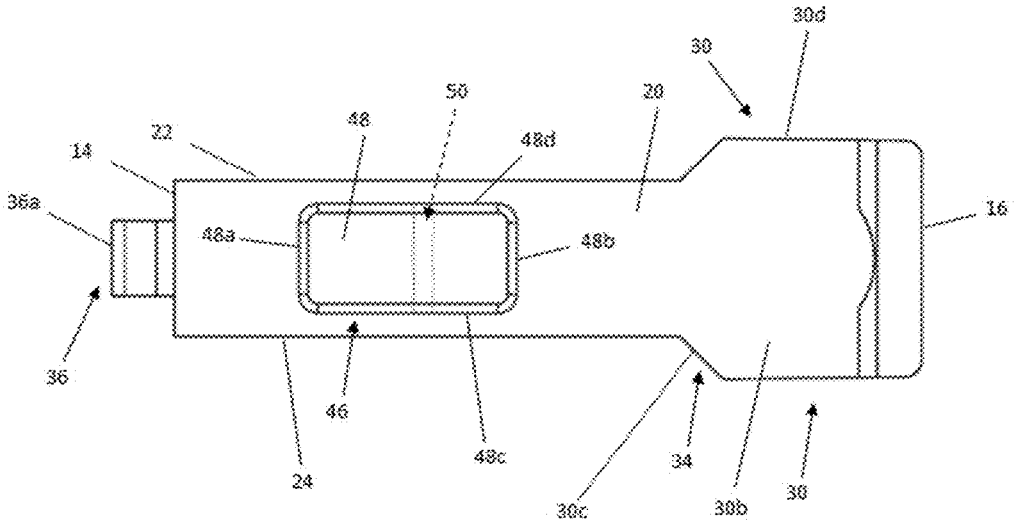
FIG. 6 is a bottom view of the follower of FIG. 1.

Turning now to FIGS. 1A and 6, the bottom surface 20 of the elongate body defines a boss 46 extending therefrom. The boss 46 defines a generally rectangular configuration, although any suitable configuration is contemplated, such as a square, an oval, a circle, etc. The boss 46 defines a generally planar surface 48 extending between a first end surface 48*a* and a second, opposite end surface 48*b*, and opposed side surfaces 48*c* and 48*d*, respectively. The opposed side surfaces 48*c*, 48*d* define a throughhole 50 therethrough configured to receive a portion of a suitable biasing element capable of biasing the follower 10 toward an upper opening in the magazine housing 100, as will be described in further detail hereinbelow. In embodiments, the bottom surface 20 may be planar and not include the boss 46 thereon, although it is contemplated that the bottom surface 20 may define any suitable configuration, such as concave, convex, arcuate, or may define a surface that inclines or declines relative to a respective arm of the first and second arms 36, 42 or a respective side surface of the opposed side surfaces 22, 24 of the elongate body 12.

It is contemplated that the follower may be formed from any suitable material, such as polymeric, metallic, ceramic, composite, etc., such as High Density Polyethylene (HDPE), nylon (nylon 6/10, nylon 6/6, etc.), glass filled nylon, cast metals (aluminum, steel, etc.), sheet metal, etc. In one non-limiting embodiment, the follower 10 is formed from HDPE.

FIG. 7 illustrates the follower 10 received within a magazine housing 100. The magazine housing 100 defines a generally rectangular profile extending between an upper surface 102 and an opposite bottom surface 104. The magazine housing defines opposed side surfaces 106 and 108, respectively, and front and rear surfaces (not shown) extending therebetween. The upper surface 102 defines a blind hole 110 therein and extending toward, but not through, the bottom surface 104 and terminating at an inner floor 112. The blind hole 110 defines opposed first and second inner side surfaces 114 and 116, respectively and a front inner surface (not shown) and an opposite, rear inner surface 118, extending therebetween. The first inner side surface 114 defines a channel 120 therein extending from the inner floor 112 and through the upper surface 102. The channel 120 is configured to slidably receive the first arm 36 of the follower 10 therein to inhibit the follower 10 from rotating towards the front inner surface or rear inner surface 118 and to provide a bearing surface having an increased surface area compared to a planar surface. The second end surface 16 of the elongate body 12 is disposed adjacent to the second inner side surface 116 of the magazine housing 100.

Continuing with FIG. 7, a follower biasing element 122 is interposed between the bottom surface 20 of the elongate body 12 of the follower 10 and the inner floor 112 of the magazine housing 100. The follower biasing element 122 is configured to bias the follower 10 towards the upper surface 102 of the magazine housing 100 to feed projectiles (not shown) contained within the magazine housing 100 into the receiver (not shown) of a suitable firearm (not shown) to which the magazine is attached. Although generally illustrated as defining a generally wishbone configuration, it is contemplated that the follower biasing element 122 may be any suitable biasing element capable of being used in a magazine housing, such as a coil spring or the like.

FIG. 8 illustrates another embodiment of a magazine housing generally identified by reference numeral 200. The magazine housing 200 is substantially similar to that of magazine housing 100, and therefore only the differences therebetween will be described in detail herein for purposes of brevity. The magazine housing 200 defines a generally arcuate or banana shaped configuration to increase the number of projectiles to be stored therewithin. To accommodate the arcuate profile of the magazine housing 200, a follower biasing element 202 having a generally coil spring configuration is interposed between an inner floor 204 of the magazine housing 200 and the bottom surface 20 of the elongate body 12 of the follower 10. A portion of the follower biasing element 202 is received within the throughhole 50 of the boss 46 of the follower 10 to capture the follower biasing element 202 and inhibit the follower biasing element 202 from becoming detached therefrom.

It will be understood that various modifications may be made to the embodiments of the presently disclosed spinal implant. Therefore, the above description should not be construed as limiting, but merely as exemplifications of embodiments. Those skilled in the art will envision other modifications within the scope and spirit of the present disclosure.

What is claimed is:

1. A follower for use in a firearm magazine, comprising: an elongate body defining a top surface, the top surface defining a first plane that is co-planar with an upper surface of the firearm magazine, the top surface extending between a first end portion and a second, opposite end portion, the first and second end portions defining grooves therein that are disposed on respective planes oriented co-planar to the first plane of the elongate body, wherein a portion of each groove is configured to scrape contaminants from an inner surface of the firearm magazine.

2. The follower according to claim 1, wherein the grooves define a dovetail configuration.

3. The follower according to claim 1, wherein side surfaces of each groove define an angle relative to each respective first and second end portion.

4. The follower according to claim 2, wherein the angle is less than 90 degrees but greater than 80 degrees.

5. The follower according to claim 2, wherein the angle is at least 80 degrees.

6. The follower according to claim 1, wherein the elongate body defines an upper surface extending between the first and second end portions, the top surface defining a boss extending therefrom and having a portion thereof being flush with the second end portion of the elongate body.

7. The follower according to claim 6, wherein the boss extends towards the first end portion for at least one third of the length of the elongate body.

8. The follower according to claim 7, wherein the elongate body defines opposed side surfaces extending between the first and second end portions, each of the first and second end portions defining a respective wing extending therefrom.

9. The follower according to claim 8, wherein each wing defines an upper surface having a bevel extending therefrom and towards an upper surface of the boss.

10. The follower according to claim 9, wherein the bevel is offset towards each respective opposed side surface of the elongate body such that a portion of the upper surface of each respective wing is exposed.

11. The follower according to claim 10, wherein the exposed portion of the upper surface of each respective wing is angled towards each respective side surface of the opposed side surfaces.

12. The follower according to claim 11, wherein the angle between the exposed portion of the upper surface and a respective side surface of the opposed side surfaces is at least 80 degrees.

13. A follower for use in a firearm magazine, comprising:

an elongate body defining a top surface, the top surface defining a first plane that is co-planar with an upper surface of the firearm magazine, the top surface extending between a first end portion and a second, opposite end portion, the first and second end portions defining grooves therein that are disposed on respective planes oriented co-planar to the first plane of the elongate body, the grooves defining a dovetail configuration.

* * * * *